United States Patent [19]

Ishikawa

[11] Patent Number: 5,054,212

[45] Date of Patent: Oct. 8, 1991

[54] GAS-SEALING DEVICE FOR WEB PASSAGE SECTION LOCATED AT TREATMENT CHAMBER WALL

[75] Inventor: Norio Ishikawa, Kanagawa, Japan

[73] Assignee: Fuji Photo Film Co., Ltd., Kanagawa, Japan

[21] Appl. No.: 655,600

[22] Filed: Feb. 15, 1991

[30] Foreign Application Priority Data

Feb. 20, 1990 [JP] Japan ..... 2-37161

[51] Int. Cl.[5] ..... F26B 25/00

[52] U.S. Cl. ..... 34/155; 34/242

[58] Field of Search ..... 34/242, 155, 156; 432/64, 242

[56] References Cited

U.S. PATENT DOCUMENTS

| | | | |
|---|---|---|---|
| 3,706,138 | 12/1972 | Schuierer | 34/242 |
| 4,268,977 | 5/1981 | Geiger | 432/242 |
| 4,285,668 | 8/1981 | Pepe | 34/242 |
| 4,354,686 | 10/1982 | Imanishi et al. | 34/242 |
| 4,442,611 | 4/1984 | Günther et al. | 432/242 |
| 4,622,762 | 11/1986 | Reed | 34/242 |
| 4,664,813 | 5/1987 | Schneider | 34/242 |
| 4,793,073 | 12/1988 | Leuchter | 34/242 |
| 4,894,009 | 1/1990 | Kramer et al. | 34/242 |

FOREIGN PATENT DOCUMENTS 51-135809 11/1976 Japan .
51-136511 11/1976 Japan .

*Primary Examiner*—Henry A. Bennett
*Assistant Examiner*—Denise L. F. Gromada
*Attorney, Agent, or Firm*—Sughrue, Mion, Zinn, Macpeak & Seas

[57] ABSTRACT

A gas-sealing device for a web passage section through the wall of a treatment chamber which enables effective sealing to be achieved not only in a small space but also with a small volume of gas, thereby contributing to a reduction of both equipment and operating costs. First and second gas jetting devices facing opposite sides of a web at the wall of the treatment chamber. Each of the first and second gas jetting devices includes a first slot for jetting a pressurized inert gas toward the treatment chamber, a second slot for jetting a gas containing a low-content gas, the second slot being on the treatment-chamber side of the first slot, and a third slot for sucking air and other gases, the third slot being on the outside side of the first slot.

11 Claims, 3 Drawing Sheets

GAS-SEALING DEVICE FOR WEB PASSAGE SECTION LOCATED AT TREATMENT CHAMBER WALL

BACKGROUND OF THE INVENTION

The present invention relates to a gas-sealing device for a web passage section located at a wall of a treatment chamber in which a web, strip, or the like is treated by causing it to pass through a drier, a thermal treatment device, or the like.

When a web such as a plastic film is passed through a drier after being charged or a strip such as a steel strip, a copper strip or an aluminum strip is passed through a thermal treatment device, various considerations have heretofore been given to the web passage section through which the web or strip (hereinafter collectively referred to as a "web") enters or exits the drier or thermal treatment chamber in order to prevent explosion or ignition due to ingress of external air into the treatment chamber and as well as to prevent leakage of toxic gases from the treatment chamber.

In one approach, the web passage section located at the wall of the treatment chamber is provided with a nip roller for the web or a packing seal to prevent circulation of air and gases. However, a sealing device formed by a nip roller is not satisfactory in that defects on the roller can cause damage to the web, while a packing seal has the shortcoming that foreign matter adhering to the packing damages the web. To overcome these problems, non-contact type sealing devices using a gas are gaining importance.

Non-contact type gas-sealing devices for a web passage section include a suction-type gas-sealing device for continuous thermal treatment furnaces (see Japanese Patent Application Unexamined Publication No. Sho. 51-135809) and a sealing device for thermal treatment furnaces (Japanese Patent Application Unexamined Publication No. Sho. 51-136511). As shown in FIG. 4(*a*), the former device includes chambers 14 arranged in a continuous thermal treatment furnace. One end of the each chamber 14 communicates with the outside 2 of the furnace and the other end thereof communicates with the inside 3 of the furnace. The chamber extends vertically with respect to a web 1 that passes between the entrance and exit sections of the furnace The chamber 14 communicates also with exhaust gas passages 15, which are provided with respective gas suction devices 16.

As shown in FIG. 4(*b*), the latter device includes plenum chambers 17 disposed so as to confront each other interposing therebetween a moving strip 1, and nozzle sections 18 confronting both surfaces of the strip 1, arranged so as to enclose guide plates 19 on surfaces of the plenum chambers 17. To charge a gas into the plenum chambers 17 under pressure, the gas is jetted from the tapered nozzle sections 18 against the surfaces of the strip 1 so that a static pressure region 20 of the gas is formed between each plate 19 and the strip 1.

However, the sealing length L is long in both devices, which requires a large volume of gas for sealing.

SUMMARY OF THE INVENTION

An object of the invention, therefore, is to overcome the above problems and to provide a gas-sealing device for a web passage section located at a treatment chamber wall which is capable of preventing circulation of gases between the treatment chamber and the outside with a short sealing length.

To achieve the above object, the invention is directed to a gas-sealing device for a web passage section located at a wall of a treatment chamber through which a web enters and exits the treatment chamber in such a manner that the treatment chamber can be sealed from outside. Such a device has a gas-sealing section having a structure including first slots for jetting a gas containing a low-content gas toward the treatment chamber across the width of the web from top to bottom, or vice versa, of the web passage section, second slots for jetting a pressurized inert gas for sealing from the first slots toward outside, and third slots for sucking air and gases from the outside. These three slots are juxtaposed.

In such a device, the web passage section at the treatment chamber wall may be provided with a roller for supporting the web.

As used herein, the term "a gas containing a low-content gas" means a gas used both to prevent direct leakage of gases from the treatment chamber to the outside and to serve as a medium containing a gas whose content is lower than the content of a gas produced within the treatment chamber. Generally, a gas supplied to the treatment chamber as a treatment gas is used.

By the term "a pressurized inert gas for sealing" is meant a gas through which the treatment chamber is isolated from the outside, specifically, a gas having the higher static pressure between the static pressure within the treatment chamber and that of the outside and which causes no harm even if circulated within the treatment chamber or leaked to the outside. Generally, pressurized nitrogen gas ($N_2$) is used.

A preferable tip profile of the slot for jetting the pressurized inert gas for sealing is such that the gap between the web and the slot is within 1 to 5 mm and small slot covers are provided to allow the jetted gas to flow to both the treatment chamber and the outside. To distribute the jetted $N_2$ gas uniformly, it is effective to cover the entire surface of the jetting slot with a wire gauze of about 1000 mesh in a rounded configuration so as to follow the jet distribution direction.

By the term "a slot for sucking air and gases" is meant a slot which serves to increase the sealing effect by sucking both the pressurized inert gas for sealing and air from the outside so as to cause air from the outside to confront the circulation of the pressurized inert gas used for sealing so that the pressurized inert gas for sealing is not leaked to the outside.

Providing the roller for supporting the web at the web passage section is done to eliminate undesired undulation of the web and to minimize the gap between the web and the gas-sealing section and the gap between the roller and the gas-sealing section in the lower part, whereby the volume of both the gases (two kinds) jetted from the gas-sealing device and the sucked gas can be minimized to the greatest possible extent, which is advantageous from the viewpoint of integrity of the device and its operation cost.

DESCRIPTION OF THE PREFERRED EMBODIMENTS

Preferred embodiments of the invention will be described with reference to the accompanying drawings, taking a drying treatment machine as an example.

Figure 1:
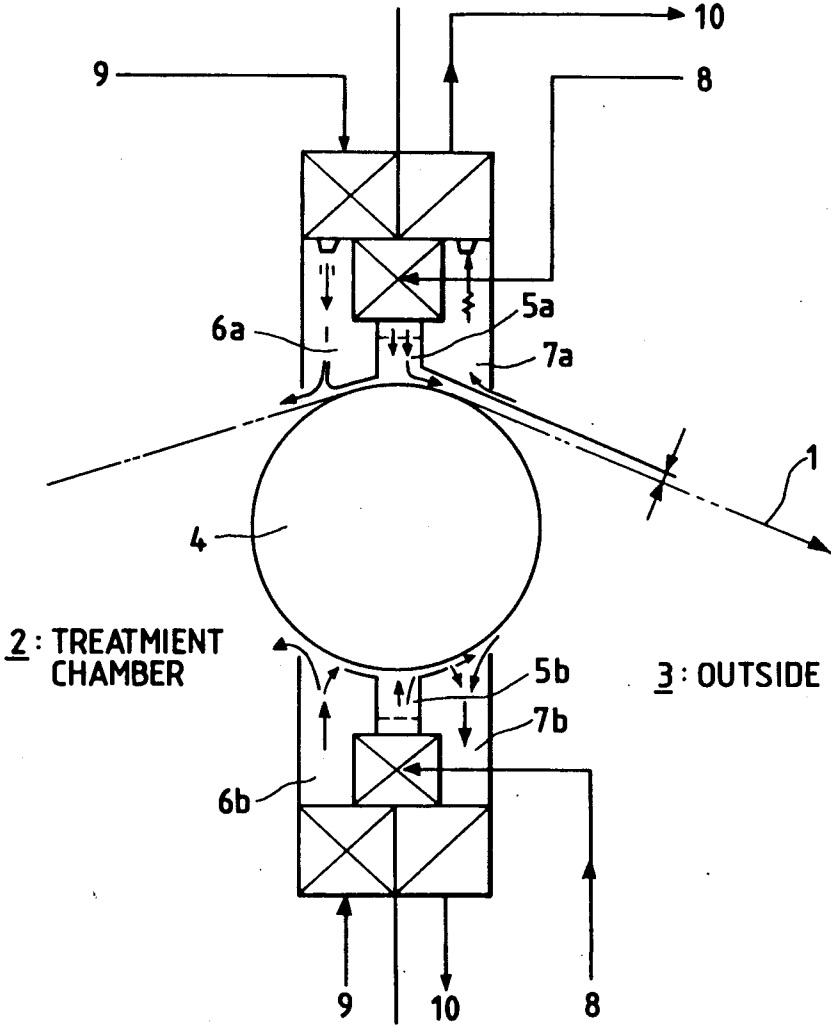
FIG. 1 is a sectional view showing a gas-sealing section of a gas-sealing device for a web passage section constructed in accordance with a preferred embodiment of the invention.

FIG. 1 is a sectional side view showing a gas-sealing device for a web passage section located at a wall of a treatment chamber, and which is constructed in accordance with a preferred embodiment of the invention.

A web 1 enters a treatment chamber 2, passes through the treatment chamber 2, and exits to the outside 3 through a web passage section. At the web passage section, the web 1 is supported by a roller 4. The gap between the upper surface of the web 1 and an upper air-sealing section and the gap between the upper surface of the roller 4 and a lower air-sealing section are preferably adjusted so that the distance between the tip of a slot 5*a* and the upper surface of the web 1 and the distance between the tip of a slot 5*b* and the lower surface of the roller 4 are generally in a range of 1 to 5 mm. The slots 5*a* and 5*b* serve to jet a pressurized inert gas for sealing. These gaps may be set to 1 mm if the roller 4 is used. Nitrogen gas ($N_2$) may be used as the inert gas jetted from these gaps. The jetting velocity of the gas from the sealing gaps at a chamber pressure of 0.1 to 5 mm (Aq) is preferably 1 to 10 m/sec. The slots are connected to pressurized inert gas sources 8 (not shown) through respective ducts.

Slots 6*a* and 6*b* for jetting a gas containing a low-content gas jet a gas which contains a gas smaller in volume than the gas produced within the treatment chamber for treatment. Such a gas is jetted to prevent not only the high-pressure gas produced within the treatment chamber 2 from leaking to the outside 3, but also gas from entering the treatment chamber 2 from the outside 3.

A jetting velocity of about 1 to 5 m/sec is employed to blow away gas evaporating from an evaporative substance on the web. The width of the jetting outlet is about 20 to 50 mm. The slots 6*a* and 6*b* are generally connected to supply respective gas sources 9 to the treatment chamber 2. Each supply gas source 9 serves to adjust not only a gas which does not affect the environment within the treatment Chamber 2, but also the component, temperature, humidity, and the like of the gas necessary to perform the required functions within the treatment chamber 2.

Slots 7*a* and 7*b* are disposed further toward the outside 3 with respect to the inert gas jetting slots 5*a* and 5*b*. The flow rate through the slots 7*a* and 7*b* for sucking both the gas jetted from the inert gas jetting slots 5*a* and 5*b* and the air from the outside 3 is about 30 to 50 $Nm^3$/hr. The slots 7*a* and 7*b* are preferably provided with respective exhaust fans 10. The width of each suction inlet is about 20 to 50 mm.

Figure 2A:
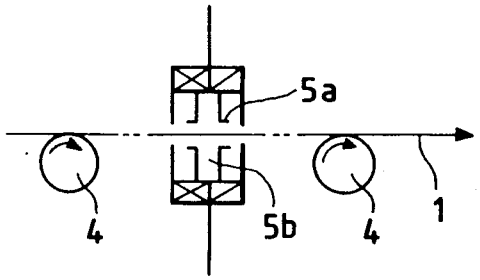
FIGS. 2(*a*) and 2(*b*) are diagrams for a description of the case where no web supporting roller is used in the web passage section shown in FIG. 1.
Figure 2B:
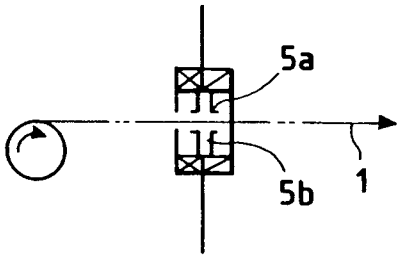

While a case where the web 1 is supported by the supporting roller 4 at the web passage section has been described, the supporting roller 4 is not necessarily provided at the web passage section. For example, as shown in FIGS. 2(*a*) and 2(*b*), there are cases where no roller is provided at the web passage section. Specifically, rollers may be provided at two sides which are distant from the web passage section, as shown in FIG. 2(*a*), or no roller is used around the web passage section at all, as shown in FIG. 2(*b*). However, these arrangements are possible only when the web has a sufficient rigidity. In these cases, not only must the gap between the web 1 and the pressurized inert gas jetting slots 5*a* and 5*b* be increased (e.g., to 5 mm), but also both the jetting flow rate and the exhaust gas flow rate must be increased commensurate therewith.

Figure 3:
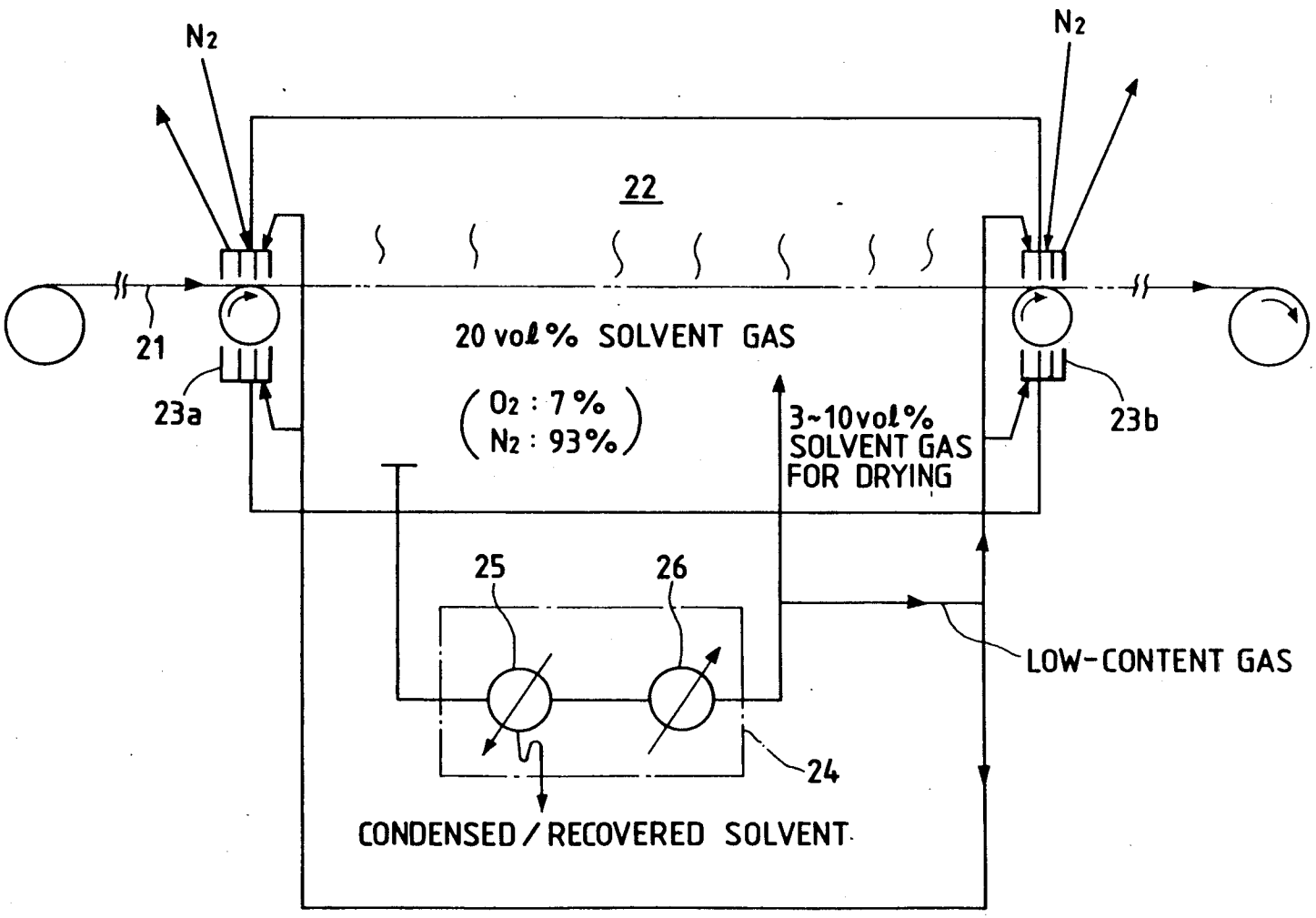
FIG. 3 is a flow diagram indicating the case where the gas-sealing device for the web passage section according to the invention is applied to a solvent drying device.
Figure 4A:
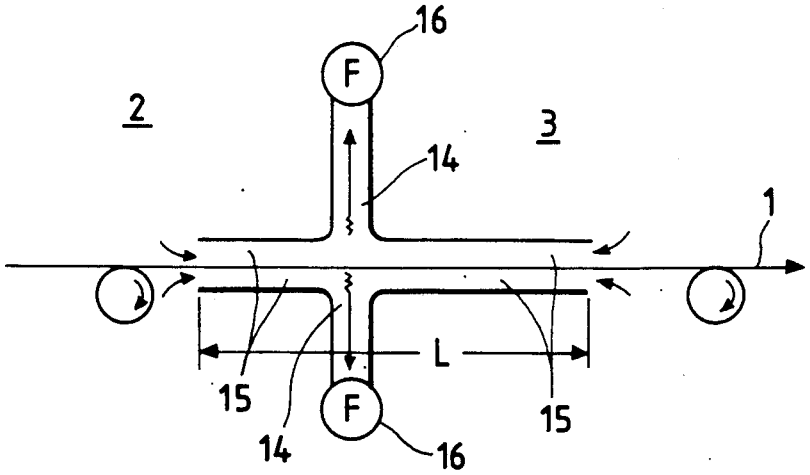
FIG. 4(a) PRIOR ART
FIGS. 4(*a*) and 4(*b*) are sectional views showing conventional gas-sealing sections.
Figure 4B:
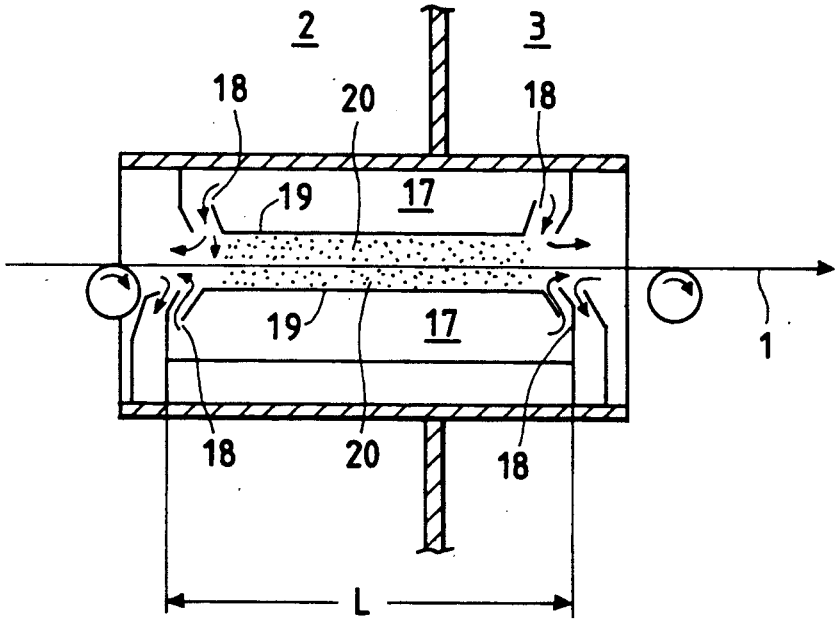
FIG. 4(b) PRIOR ART

An exemplary application of the invention will be described with reference to FIG. 3 of the accompanying drawings. The invention is not limited to this application, however.

This application is applied to the treatment of drying a cellulose triacetate film. As shown in FIG. 3, when a web 21, which is a cellulose triacetate film, enters a drier 22 (which corresponds to a treatment chamber), the web 21 passes through a gas-sealing device 23*a* located at an entrance web passage section. After having been treated, the web 21 passes to the outside in a similar manner, passing through a gas-sealing device 23*b* located at an exit web passage section. The drier 22 contains 20 vol. % of methylene chloride which has been evaporated through a drying process. Under this state, introduction of air (generally composed of about 78 vol. % of $N_2$ and 21 vol. % of $O_2$) into the drier 22 is not preferable from the viewpoint of preventing explosion or ignition. Moreover, discharge of methylene chloride within the drying chamber into the outside working room is, of course, prohibited for reasons of industrial safety.

A drying gas containing as much as 20 vol. % of methylene chloride produced by evaporating a solvent for the charged web within the drier 22 is condensed by cooling the solvent contained in the drying gas by a condenser 25 recovered by a solvent recovering device 24. The recovered drying gas is transformed into a gas containing a low-content (3 vol. %) of methylene chloride. After having its temperature adjusted by a heater 26, the drying gas thus treated is recirculated within the drying chamber.

A gas-sealing operation was performed using the gas-sealing devices 23*a* and 23*b* under the following conditions. Each of the gas-sealing devices 23*a* and 23*b* of the web passage sections of the drier 22 had a structure as shown in FIG. 1. When the pressure within the drying chamber was 1 mm (Aq), each slot for jetting a pressurized inert gas for sealing (5*a*, 5*b*) had a width of 20 mm for jetting $N_2$ gas whose flow rate was 40 $Nm^3$/hr. Each low-content gas-containing gas jetting slot (6*a*, 6*b*) had a width of 40 mm, while each air/gas suction slot (7*a*, 7*b*) had a width of 40 mm for sucking the air/gas at a rate of 40 $Nm^3$/hr.

The gas-sealing device for the web passage section according to the invention enables effective sealing to be achieved not only in a small space but also with a small volume of gas, thereby contributing to a reduction of both equipment and operating costs.

In addition, the device, being small in structure, allows easy assembly and maintenance.

The invention can be applied not only to driers but also to sealing devices for web passage sections located at walls of a treatment chamber that must be isolated from outside. The pressurized inert gas can be used to adjust the contents of the gas components within the treatment chamber. No toxic gas within the treatment chamber is leaked nor will any gas enter from the outside, thereby providing advantages in industrial safety and hygiene.

What is claimed is:

1. A gas-sealing device for a web passage section located at a wall of a treatment chamber through which a web enters and exits said treatment chamber for sealing said treatment chamber from the outside, comprising: first and second gas jetting devices facing each other through said web at said wall of said treatment chamber, each of said first and second gas jetting devices comprising means defining a first slot for jetting a pressurized inert gas, means defining a second slot for jetting a gas containing a low-content gas, said second slot being on the treatment-chamber side of said first slot, and means defining a third slot for sucking air and other gases, said third slot being on the outside side of said first slot, said first, second and third slots being juxtaposed with respect to one another.

2. The gas sealing device of claim 1, further comprising a roller for supporting said web disposed between said first and second gas jetting means, said web passing between said first gas jetting means and said roller, said first gas jetting means facing said web and said second gas jetting means facing a side of said roller opposite said web.

3. The gas sealing device of claim 2, wherein said means defining said first slot comprises a slot cover extending on one side of said first slot toward the outside from said first slot and on the other side of said first slot toward said treatment chamber.

4. The gas sealing device of claim 1, wherein a gap between a tip of said first and second slots and respective sides of said web is in a range of 1 to 5 mm.

5. The gas sealing device of claim 2, wherein a gap between a tip of said first slot of said first gas jetting device and said web and a gap between a tip of said first slot of said second gas jetting device and said web is approximately 1 mm.

6. The gas sealing device of claim 1, wherein said inert gas is nitrogen.

7. The gas sealing device of claim 1, wherein a gas jetting velocity of said inert gas is in a range of 1 to 10 m/sec for a treatment chamber pressure in a range of 0.1 to 5 mm (Aq).

8. The gas sealing device of claim 1, wherein a gas jetting velocity of said inert gas containing a low-content gas is in a range of 1 to 5 m/sec.

9. The gas sealing device of claim 1, wherein a width of said second slots is in a range of 20 to 50 mm.

10. The gas sealing device of claim 1, wherein a flow rate through said third slots is in a range of 30 to 50 $Nm^3/hr$.

11. The gas sealing device of claim 1, wherein a width of said third slots is in a range of 20 to 50 mm.

* * * * *